United States Patent [19]

Cowlin et al.

[11] 4,184,598

[45] Jan. 22, 1980

[54] MANUALLY OPERATED POSITION DETECTOR FOR A CONVEYOR ARTICLE SORTER

[75] Inventors: Robert M. Cowlin, Chelmsford; Peter G. Long, Colchester; Leslie F. Sapsed, Coldnorton; John F. Steward, Billericay, all of England

[73] Assignee: Lockwood Graders (UK) Limited, Chelmsford, England

[21] Appl. No.: 840,529

[22] Filed: Oct. 11, 1977

[30] Foreign Application Priority Data

Oct. 8, 1976 [GB] United Kingdom ..... 41940/76
Nov. 22, 1976 [GB] United Kingdom ..... 48680/76

[51] Int. Cl.[2] ..... B07C 5/00
[52] U.S. Cl. ..... 209/705; 209/938
[58] Field of Search ..... 209/702, 705, 938, 942; 214/11 R, 11 A, 11 C, 1 PE, 6 P; 198/779, 358, 360, 367, 502; 414/134, 135, 136

[56] References Cited

U.S. PATENT DOCUMENTS

| | | | |
|---|---|---|---|
| 214,765 | 4/1879 | Fink | 209/705 |
| 1,677,656 | 7/1928 | Roberts et al. | 198/779 X |
| 2,230,279 | 2/1941 | Wilcox | 209/942 X |
| 2,759,391 | 8/1956 | Lehman | 209/938 X |
| 3,433,966 | 3/1969 | Letch et al. | 198/502 X |
| 3,484,655 | 12/1969 | Peltier | 198/367 X |

*Primary Examiner*—Joseph J. Rolla
*Assistant Examiner*—Edward M. Wacyra
*Attorney, Agent, or Firm*—Schwartz & Weinrieb

[57] ABSTRACT

An article sorting apparatus provides a continual indicator stream which is directed by operation of an indicator member onto a selected article of several articles conveyed through an inspection area. The position of the indicator member when the stream impinges on it is detected to generate a position-dependent signal which is fed to a deflector to deflect the selected article from the path followed by the other articles.

17 Claims, 3 Drawing Figures

MANUALLY OPERATED POSITION DETECTOR FOR A CONVEYOR ARTICLE SORTER

FIELD OF THE INVENTION

The present invention relates to apparatus for sorting articles and has particular, but not exclusive, application to the sorting of root vegetables, for example, potatoes.

BACKGROUND OF THE INVENTION

It is now common practice in potato harvesting to employ automatic means to separate potatoes from soil and stones and to grade the crop by size. However, quality selection (that is, the removal of sub-standard potatoes from acceptable potatoes) has not been effectively automated and still relies upon operators picking out sub-standard potatoes as the crop passes along an inspection table. This quality procedure is inefficient in terms of labour deployment and is usually the speed-determining step in potato handling.

It has previously been proposed to improve operator efficiency by providing automatic removal means responsive to a position-indicating signal from a manually operable indicator. In said system, the indicator comprises an oscillating coil which is actuated when the indicator is pressed on a potato to be rejected and the position of said potato is indicated by a signal induced by an orthogonal array of coils disposed beneath the inspection table. Such a system has a number of inherent disadvantages, including the need to physically contact sub-standard potatoes and to carefully align potatoes on the table relative to said array because of lack of good resolution.

SUMMARY OF THE INVENTION

The present invention provides an alternative system of generating a position-indicating signal for use in potato sorting which does not require physical contact with the reject potato and which readily can be designed to eliminate, or at least reduce, the degree of potato alignment required on the inspection table and to operate at a higher resolution than said known system. It will be appreciated that the system of this invention has application to sorting other articles, especially, but not exclusively, other root vegetables and bulbs.

According to the present invention there is provided article sorting apparatus comprising conveying means simultaneously conveying two or more articles to be sorted through an inspection area;

a reference frame in fixed spatial relationship to said area;

a rigid indicator member carried by said frame and movable with respect thereto;

emitter means for emitting a continual stream of energy or matter at a fixed angle to the indicator member and movable with said member to selectively impinge on locations within the inspection area to indicate a transient position of an article in said area;

signal means responsive to the position of the indicator member relative to the reference frame for generating a position-dependent signal;

switch means for selectively actuating said signal means to generate a signal indicative of said transient position; and deflector means responsive to said signal for selectively deflecting said indicated article.

In its simplest form, the indicator member is movable in only one dimension over the inspection area but it is preferred and usual for the indicator member to be moved in both dimensions of the inspection area. Conveniently, the indicator member is pivotally mounted in the reference frame, especially in a swivel joint. It is especially preferred that the swivel joint provides the indicator member with a locus which is a solid sector of a sphere. Suitably, the indicator member is an elongate arm which can extend beyond (with respect to the inspection area) its mounting in the reference frame to permit the signal means to be arranged to detect the position of the arm beyond said mounting.

The signal means preferably is a transducer providing an electrical position-dependent signal. In particular, the transducer can comprise an orthogonal detector array providing orthogonal co-ordinates of the part of the indicator member detected by the array. Conveniently, the position of the indicator member is detected electrostatically.

The stream emitted by the emitting means can be formed of energy (for example, light) or matter (for example, air) but usually will be electromagnetic radiation. It is especially preferred that the radiation is light in the visible range. However, provided that, where necessary, appropriate steps are taken to be able to detect when the stream impinges on an article or location within the inspection area, other streams, especially of non-visible electromagnetic wave lengths, can readily be employed. Usually, it will be intended that the stream should impinge directly on an article to be indicated although other arrangements, such as impinging upon an indicium carried by the conveying means and adjacent the article, can be employed.

Whilst the stream can be emitted at any fixed angle relative to the indicator member, it is advantageous for the stream to be emitted in the direction of, and preferably co-axial with, the axis connecting the proximal (with respect to the inspection area) and mounted parts of the indicator member.

The switch means usually will be a manually operable switch, especially a trigger mounted on the indicator member. However, the switch could be an automatic switch responsive to, for example, the colour of the article upon which the stream impinges. It is preferred that upon operation of the switch means to actuate the signal means, the stream from the emitter means is simultaneously interrupted to provide an indication of said actuation.

The position-dependent signal from the signal means is supplied as a control signal to the deflector means in order that said deflector means can selectively deflect articles upon which, or adjacent which, the stream impinged when the switch means was operated. Usually, the deflector means will be located downstream of the inspection area and in this case the signal will be processed in order to compensate for the time delay for the article to pass from its indicated transient position to the deflector means. The deflector means can comprise fingers for deflecting the articles passing from the conveyor means. In the case of potatoes or other root vegetables or bulbs, the said fingers can be of the kind well known per se for separating said produce from soil and stones using, for example, X-ray beams.

The conveying means preferably comprises a roller table over which the articles are conveyed in the inspection area. A roller table is a conveyor formed of a plurality of rotatable elongate members ("rollers") connected together by, for example, side chains to form an endless array in which the rollers are spaced apart with their axes parallel and transverse to the direction of translational movement. Articles are conveyed in transversely extending rows supported by adjacent pairs of rollers. The rollers are rotated over at least part of the endless conveyor path in order to rotate the articles conveyed thereon to evenly distribute the articles on the conveyor and/or to sequentially present the whole surface of the articles for inspection.

It is usual for the rollers to be rotated by means of frictional contact with a stationary surface over which they are moved. The resultant rotation is such that, at a position diagonally opposite the point of contact with the surface, the perimetral surface of the roller is moving in the translational direction of the endless path of the roller table. Accordingly, at said position the translational speed of the surface is greater than the translational speed at which the roller axes are moved along the endless conveyor path. This increased speed is of advantage when the rotation of the rollers is required to evenly distribute articles over the roller table. However, it has been found that the increased speed is undesirable when the items are to be rotated for inspection purposes. In particular, the increased speed causes nausea. It is therefore preferred that the rollers of the roller table in the inspection area are rotated so that the perimetral surface at the upper part of the roller moves in the opposite direction to translation of the roller axes.

We have found that a simple and effective means of rotating the rollers of the roller table in the said preferred manner is to provide in frictional contact with the lower part of the rollers a surface movable in the same translational direction and sense as the roller axes. It will be appreciated that depending upon the speed with which the surface is moved the rotation of the rollers will be slowed or reversed compared with their movement over the surface when stationary.

Preferably, the surface is moved at a greater speed than the translational speed of the roller axes. In practice, it has been found that a speed of about 1.5 times the said translational speed of the roller axes is suitable. Conveniently, the movable surface is provided by an endless belt.

It is preferred that the rollers frictionally engage a stationary surface in a distribution area upstream of the inspection area to distribute articles on the roller table. In order to permit the rollers smooth transition from rotation in one sense on the stationary surface to rotation in the opposite sense on the movable surface, it is especially preferred that the rollers do not engage any surface in an intermediate area between said distribution and inspection areas.

It is preferred that the inspection area of the roller table or other conveying means is horizontal or inclined downwardly in the direction of translational movement of the article. In contrast, when a roller table is provided with a distribution area, it is preferred that the roller table in that area is inclined upwardly in said direction of translational movement.

It will be appreciated that the provision in a roller table of a movable surface in the manner described above is of general application and not restricted to sorting apparatus of the present invention.

When the signal means responds electrostatically to the position of the indicator member, it is preferred that said means comprises a charge probe and an array of conductors over which the probe is relatively movable. One of said probe and array, usually the probe, is movable with the indicator and the other of said probe and array is fixed to the reference frame. The conductors are spaced apart so that the probe crosses a set of conductors when the indicator is moved in one or each dimension. Usually, the conductors will be arranged in a grid with two manually perpendicular sets of spaced parallel conductors to provide respectively orthogonal co-ordinates. Voltage pulses are applied sequentially to the conductors of the or each set and the resultant charge is detected electrostatically by the probe.

BRIEF DESCRIPTION OF THE DRAWINGS

The following is a description by way of example only and with reference to the accompanying drawings of a presently preferred embodiment of the invention. In the drawings.

DETAILED DESCRIPTION OF THE PREFERRED EMBODIMENT

Figure 2:
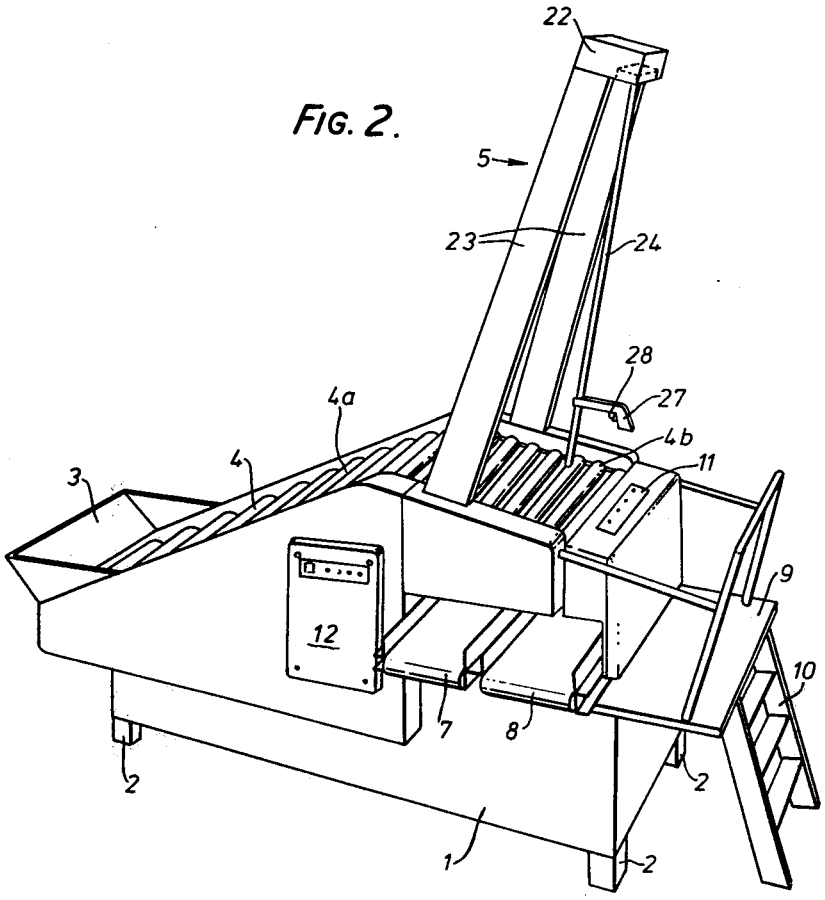
FIG. 2 is a perspective view of the potato sorter shown diagrammatically in FIG. 1.

Referring to the drawings, and more particularly to FIG. 2 thereof, a potato sorting machine comprises a body 1 formed of a framework supported on four legs 2 and clad with casing sheets. A hopper 3 is provided at the rear of the machine to receive the potatoes from, for example, a pre-cleaner in which clods and stones have been separated from the potatoes. A roller table conveyor 4 conveys the potatoes from the hopper along an upwardly inclined path **4*a* to a slightly downwardly inclined inspection area 4*b* at the forward end of the machine. A position indicating assembly 5 is provided above the inspection area for manual operation to indicate reject potatoes passing through the inspection area 4*b*. A signal from the assembly 5 actuates appropriate fingers of a finger bank 6 to deflect reject potatoes onto a reject conveyor 7. In the absence of a signal from the assembly 5, the fingers direct the potatoes onto a produce conveyor 8. An operator platform 9 accessible by a ladder 10 is provided at the forward end of the machine. Controls and indicators required for the routine operation of the machine are provided in dashboard 11 readily accessible from the operator platform 9. Other controls and indicators are provided in a console 12** located on one side of the body and control circuitry is provided behind the console for easy access.

The roller table 4 and conveyors 7 and 8 are driven in conventional manner by chains and sprockets (not shown) from a central motor (also not shown). The electrical supply for the motor and for other electrical components is provided from a mains 240 volt AC supply. The finger bank 6 is pneumatically operated in known manner by compressed air from an electrical compressor (not shown) provided in the body 1.

Figure 1:
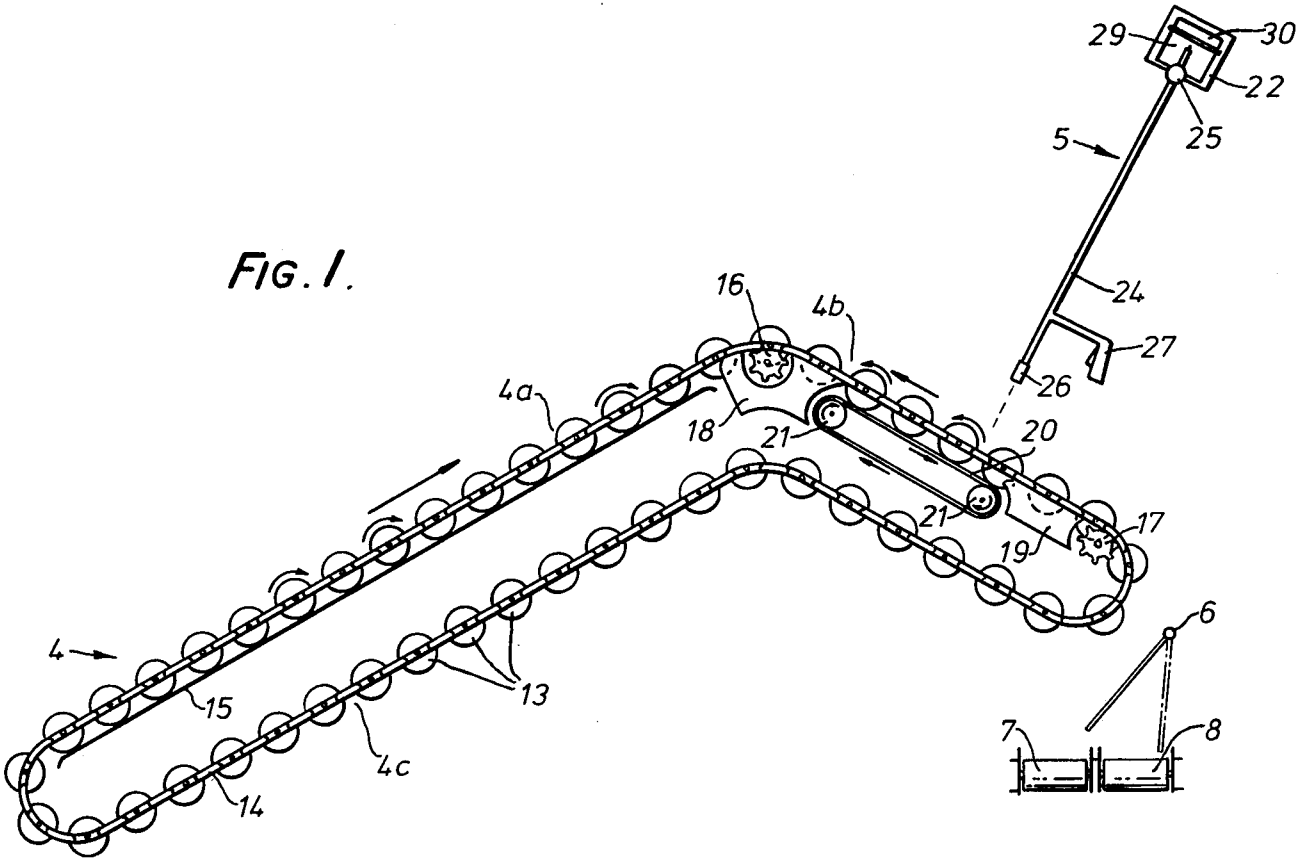
FIG. 1 is a schematic side view of a potato sorter in accordance with a preferred embodiment of the present invention.
Figure 3:
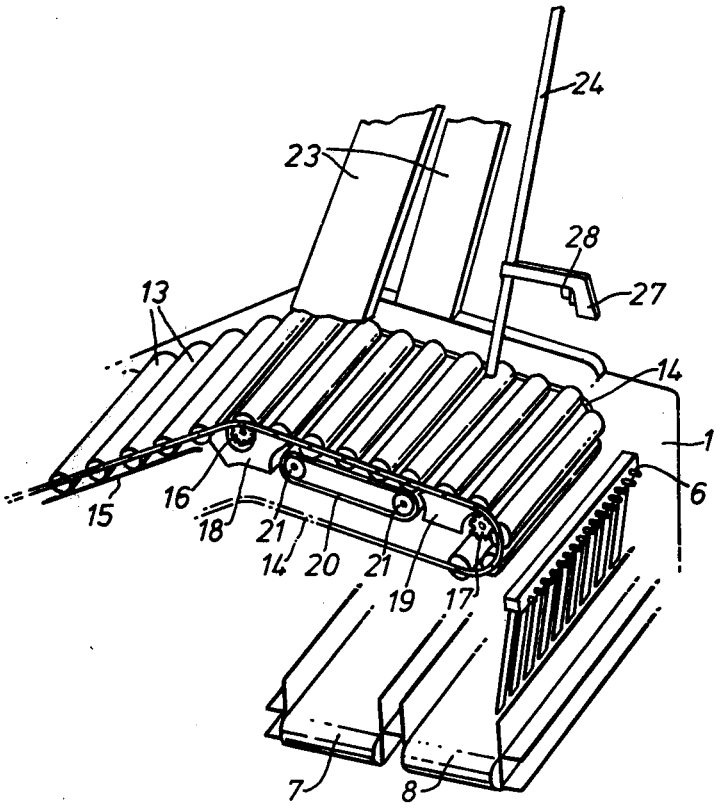
FIG. 3 is a view on a larger scale corresponding to FIG. 2 and showing part of the potato sorter with some casing and frame members omitted.

The roller table 4 comprises a plurality of right circular wooden rollers 13 rotatably mounted in an endless array with their axes parallel between two transversely spaced endless side chains 14 in known manner, as seen in FIGS. 1 and 3. The path of the roller table extends from the hopper 3 along the upwardly inclined path **4*a* to the inspection area 4*b* and then returns along a lower return path 4*c* to the hopper. In the path 4*a***, the rollers 13 rest upon a pair of transversely spaced support runners 15 whereby the translational movement of the rollers 13 along the path 4*a* imparted by the driven chains 14 cause the rollers 13 to rotate in the clockwise direction as viewed in the Figures. A pair of transversely spaced sprockets 16 are provided at the top of path (flight) 4*a* to engage respective side chains 14 and a corresponding pair of sprockets 17 are provided to engage and support the respective side chains 14 at the forward end of the inspection area 4*b*. Respective wooden blocks 18, 19 are provided adjacent to the sprockets 16, 17 to support the respective side chains 14 and thereby to allow the rollers 13 to lose rotational momentum.

An endless belt 20 supported by spaced drive rollers 21 is located within the roller table between the blocks 18 and 19 so that the rollers 13 in the inspection area rest upon the upper flight of the belt 20. The belt is driven by the rollers 21 so that the upper flight moves in the same translational direction as the rollers 13 in contact therewith. Suitably, the belt 20 is moved at about 1.5 times the translational speed of the rollers and thereby cause the rollers to rotate in an anti-clockwise direction as viewed in the Figures.

It will be appreciated that the translational speed of the upper surface of the rollers 13 when in contact with the support runners 15 is greater than the translational speed of the chains 14 because of the rotation imparted by contact with the runners 15. This condition is advantageous for distributing potatoes from the hopper 3 into transversely extending rows where they rest between adjacent pairs of rollers. When the rollers 13 are in contact with the belt 20, the upper surface of the rollers 13 move in the opposite translational sense to the chains 14. The difference in speed between the said upper surface and the chains is such that the upper surface moves at half the translational speed of the chains. The slower speed is advantageous because the potatoes rotate at a relatively slower speed enabling defects in the potatoes to be more easily observed. Moreover, since the potatoes rotate in the opposite sense to the rollers, the upper surfaces of the potatoes will be moving in the same sense as the chains and thereby are less likely to cause feelings of nausea in operatives inspecting the potatoes for defects.

The position indicating assembly 5 has a reference frame comprising a head 22 supported by a pair of mutually convergent frame members 23 extending upwardly from the machine body 1 and inclined forwardly. A rigid cylindrical tube 24 is supported near its upper end in a ball joint 25 carried by the head 22 and permitting angular movement of the tube to point at any position in the inspection area 4*b*. The tube 24 has a focussed light source 26 at its lower end (that is, proximal relative to the inspection table) to emit a pencil beam of visible light so-axially from the tube 24. Suitably, the source 26 comprises a lamp together with a collimator and focussing lens of long focal length. A handle 27 extends laterally from the tube 24 in order to facilitate movement of the tube by an operative standing on platform 9. An electrical trigger switch 28 is mounted on the handle 27 for a reason hereinafter described.

The upper end of tube 24 protrudes from the ball joint 25 and has a charge probe 29 mounted co-axially on its upper end (see schematic representation in FIG. 1). Said probe forms part of an electrostatic position transducer mounted in the head 22. A grid plate 30 is fixedly mounted in the head 22 above the probe 29. This plate 30 comprises a non-conductive support plate having a first set of spaced parallel electrical conductors on its upper surface and a second set of parallel electrical conductors on its lower surface. The conductors of the first set extend in the forward direction of the machine and sense the position of the probe in the transverse direction of the machine. The conductors of the second set are mutually perpendicular to those of the first set and sense the position of the probe in the forward/rearward direction of the machine. The position of the probe is detected in a manner known per se by passing electrical pulses sequentially along the two sets of conductors. The transducer is operated by the trigger 28 so that a position-dependent signal is generated only when the trigger is operated by the operative. The trigger is also connected in the supply circuit to the light source 26 so that the light source is extinguished when the trigger is operated. The signal from the transducer provides the orthogonal co-ordinates of the point of the inspection area upon which the light beam impinged when the trigger was operated. The transverse position of a potato on a full roller table will not change substantially during passage from the point of indication to the forward discharge end of the table. However, there will be a time delay before it reaches the forward end and therefore the signal from the transducer is processed in a logic circuit responsive to the translational speed of the roller table to compensate for this time delay. Appropriate circuitry for operation of the position indicating assembly 5 and processing of the signal will be readily apparent to those familiar with electrical control logic.

The processed signal from the assembly 5 is fed to the finger bank 6 provided at the forward end of the machine. The finger bank 6 is known per se for use in, for example, separating clods and stones from potatoes by X-ray pre-cleaners and therefore will not be described in detail. Each finger of the bank is movable independently of the remaining fingers in response to a respective processed signal from the assembly 5. If desired, each finger can be arranged to operate with an adjacent finger depending upon the transverse position of the reject potato on the inspection table. In their normal position, the fingers are inclined downwardly to direct potatoes onto the produce conveyor 8. When actuated to reject a potato a finger is caused or allowed to pivot by a small amount in a clockwise direction as viewed in the Figures to deflect reject potatoes onto the reject conveyer 7.

In operation, an operative stands on platform 9 and moves the tube 24 by means of handle 27 to point the tube at a reject potato. The light source 26 continually emits a light beam enabling the operative to see where the tube 24 is pointing. When the beam impinges upon a reject potato, the operative pulls trigger 28 thereby causing a position-dependent signal to be generated by the transducer. The light is extinguished upon pulling the trigger in order to provide an indication that the trigger has been successfully operated. The signal is processed and fed to the finger bank to move the appropriate finger or fingers to deflect the reject potato onto the reject conveyor 7 when the potato falls from the end of the roller table.

It will be appreciated that the invention is not restricted to the particular details described above with reference to the drawings. Numerous modifications and variations can be made without departing from the scope of the invention as claimed in the following claims.

What is claimed is:

1. Article sorting apparatus comprising:

conveying means simultaneously conveying two or more articles to be sorted through an inspection area;

a reference frame in fixed spatial relationship to said area;

a rigid indicator member carried by said frame and movable with respect thereto;

emitter means for emitting a continual indicator stream selected from streams of energy and matter at a fixed angle to the indicator member and movable with said member to selectively impinge said stream on locations within the inspection area to indicate a transient position of an article in said area;

signal means responsive to the position of the indicator member relative to the reference frame for generating a position-dependent signal;

switch means for selectively actuating said signal means to generate a signal indicative of said transient position; and deflector means responsive to said signal for selectively deflecting said indicated article.

2. Apparatus as claimed in claim 1 wherein the indicator member is mounted in a swivel joint.

3. Apparatus as claimed in claim 2 wherein the indicator member is an elongate arm which extends beyond its mounting in the reference frame in the direction away from said inspection area, and the signal means detects the position of the arm beyond said mounting.

4. Apparatus as claimed in claim 3 wherein the signal means is a transducer producing an electrical position-dependent signal.

5. Apparatus as claimed in claim 4 wherein the transducer comprises an orthogonal detector array providing orthogonal co-ordinates of the part of the indicator member detected by the array.

6. Apparatus as claimed in claim 5 wherein the transducer comprises a charge probe and an array of conductors, one of said probe and array being movable with the indicator and the other being fixed to the reference frame.

7. Apparatus as claimed in claim 1 wherein the emitter means emits the said stream in the direction of the axis connecting the proximal part, disposed within the vicinity of the inspection area, and the mounted part of the indicator member.

8. Apparatus as claimed in claim 1 wherein the said stream is a beam of light in the visible range.

9. Apparatus as claimed in claim 1 wherein the switch means is manually operated by a trigger mounted on the indicator member.

10. Apparatus as claimed in claim 1 wherein the deflector means is located downstream of the inspection area.

11. Apparatus as claimed in claim 1 wherein the conveying means comprises a roller table over which the articles are conveyed in said inspection area, said roller table including a plurality of rollers wherein the roller axes move translationally through said inspection area.

12. Apparatus as claimed in claim 11 wherein the perimetral surface at the upper part of the rollers in the inspection area move in the opposite direction to translational movement of the roller axes.

13. Apparatus as claimed in claim 12 wherein the lower part of the rollers of said table frictionally contact in the inspection area a surface movable in the same direction and sense as the roller axes in said area.

14. Apparatus as claimed in claim 13 wherein the translational speed of said surface is greater than the translational speed of the roller axes.

15. Apparatus as claimed in claim 14 wherein the translational speed of the surface is about 1.5 times the translational speed of the roller axes.

16. Apparatus as claimed in claim 13 wherein the said surface is an endless belt.

17. Apparatus as claimed in claim 1 wherein said articles to be sorted include root vegetables or bulbs.

* * * * *